US011873690B2

(12) United States Patent
Qi et al.

(10) Patent No.: US 11,873,690 B2
(45) Date of Patent: Jan. 16, 2024

(54) SYSTEM AND METHODS FOR POWER MAXIMIZATION FOR DOWNHOLE TRACTOR

(71) Applicant: Halliburton Energy Services, Inc., Houston, TX (US)

(72) Inventors: Yuan Qi, Houston, TX (US); Sudhir Kumar Gupta, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 180 days.

(21) Appl. No.: 17/590,987

(22) Filed: Feb. 2, 2022

(65) Prior Publication Data

US 2023/0020636 A1 Jan. 19, 2023

Related U.S. Application Data

(60) Provisional application No. 63/222,574, filed on Jul. 16, 2021.

(51) Int. Cl.
*E21B 23/00* (2006.01)
*E21B 44/00* (2006.01)

(52) U.S. Cl.
CPC ..... *E21B 23/001* (2020.05); *E21B 44/00* (2013.01)

(58) Field of Classification Search
CPC ..... E21B 23/001; E21B 44/00
See application file for complete search history.

(56) References Cited

U.S. PATENT DOCUMENTS

| | | | |
|---|---|---|---|
| 6,273,189 | B1 | 8/2001 | Gissler et al. |
| 9,777,545 | B2 | 10/2017 | Ludwig |
| 9,874,061 | B2 | 1/2018 | Bedrossian |
| 11,499,372 | B2 | 12/2022 | Qi et al. |
| 2002/0029908 | A1 | 3/2002 | Bloom et al. |
| 2002/0112859 | A1 | 8/2002 | Bloom et al. |
| 2005/0145415 | A1 | 7/2005 | Doering et al. |
| 2006/0196694 | A1 | 9/2006 | Bloom et al. |
| 2008/0135292 | A1 | 6/2008 | Sihler et al. |

(Continued)

FOREIGN PATENT DOCUMENTS

| | | | |
|---|---|---|---|
| EP | 4163472 | A1 | 4/2023 |
| WO | 2009047729 | A3 | 4/2009 |

OTHER PUBLICATIONS

Filing Receipt, Specification and Drawings for U.S. Appl. No. 63/222,574, entitled "System and Apparatus for Power Maximization for Downhole Tractor," filed Jul. 16, 2021, 33 pages.

(Continued)

*Primary Examiner* — Dany E Akakpo
(74) *Attorney, Agent, or Firm* — Conley Rose, P.C.; Rodney B. Carroll

(57) ABSTRACT

Downhole tractor control systems and methods to maintain a load of a downhole tractor are disclosed. A method to maintain a load of a downhole tractor includes identifying a reduction of power of a first set of motors of a plurality of motors of the downhole tractor, determining whether the reduction of power of the first set of motors is below a first threshold, and increasing, in response to the determination, a first power limit of a second set of motors of the plurality of motors to a maximum acceptable power limit of the second set of motors while maintaining the load of the downhole tractor.

20 Claims, 6 Drawing Sheets

(56) References Cited

U.S. PATENT DOCUMENTS

| | | | | |
|---|---|---|---|---|
| 2008/0308318 | A1 | 12/2008 | Moore | |
| 2009/0091278 | A1 | 4/2009 | Montois et al. | |
| 2009/0218105 | A1 | 9/2009 | Hill et al. | |
| 2010/0314173 | A1 | 12/2010 | Hbaieb et al. | |
| 2015/0167416 | A1* | 6/2015 | Ludwig | E21B 4/006 166/385 |
| 2016/0333653 | A1* | 11/2016 | Bonderover | E21B 4/18 |
| 2016/0362953 | A1 | 12/2016 | Bedrossian | |
| 2020/0270979 | A1 | 8/2020 | Hradecky et al. | |
| 2021/0123303 | A1 | 4/2021 | Qi et al. | |
| 2021/0254422 | A1 | 8/2021 | Sheiretov et al. | |
| 2023/0014986 | A1 | 1/2023 | Qi et al. | |
| 2023/0020636 | A1 | 1/2023 | Qi et al. | |
| 2023/0110460 | A1 | 4/2023 | Andersen | |
| 2023/0112474 | A1 | 4/2023 | Thomsen | |
| 2023/0112756 | A1 | 4/2023 | Andersen | |

OTHER PUBLICATIONS

Filing Receipt, Specification and Drawings for U.S. Appl. No. 63/222,576 entitled "Systems and Methods for Power Equalization for Multiple Downhole Tractors," filed Jul. 16, 2021, 32 pages.

Filing Receipt, Specification and Drawings for U.S. Appl. No. 17/590,990 entitled "Systems and Methods for Power Equalization for Multiple Downhole Tractors," filed Feb. 2, 2022, 38 pages.

Office Action dated Jul. 31, 2023 (15 pages), U.S. Appl. No. 17/590,990, filed Feb. 2, 2022.

* cited by examiner

SYSTEM AND METHODS FOR POWER MAXIMIZATION FOR DOWNHOLE TRACTOR

CROSS-REFERENCE TO RELATED APPLICATIONS

This application claims priority to U.S. Provisional Application No. 63/222,574 filed on Jul. 16, 2021 and entitled, "System and Apparatus for Power Maximization for Downhole Tractor." The disclosure of the aforementioned application is hereby incorporated by reference in its entirety.

TECHNICAL FIELD

The present disclosure relates generally to downhole tractor control systems and methods for maintaining or maximizing a load of a downhole tractor.

BACKGROUND

Downhole equipment used in various downhole operations including, but not limited to, drilling operations, completion operations, wireline operations, logging operations, as well as other well operations, are sometimes performed by downhole tractors that are deployed in a wellbore. Due to the limited space and heavy load conditions, a downhole tractor is usually driven by multiple motors at the same time. The load carried by the downhole tractor is a sum of the load shared by the motors within the tractor.

To maintain the total power of all motors within the maximum power limit of the downhole tractor, each motor has a power limit that is equal to the total tractor power limit divided by the number of motors. However, in abnormal working conditions, when one or more motors are malfunctioning or when one or more driving wheels are slipping in the downhole, the motors driving these wheels cannot carry the full load, and the net pull force available from the tractor decreases.

Thus, there remains a need for methods and systems that improve the downhole tractor performance and maximize the system power capability and the net pull force on a real-time basis.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
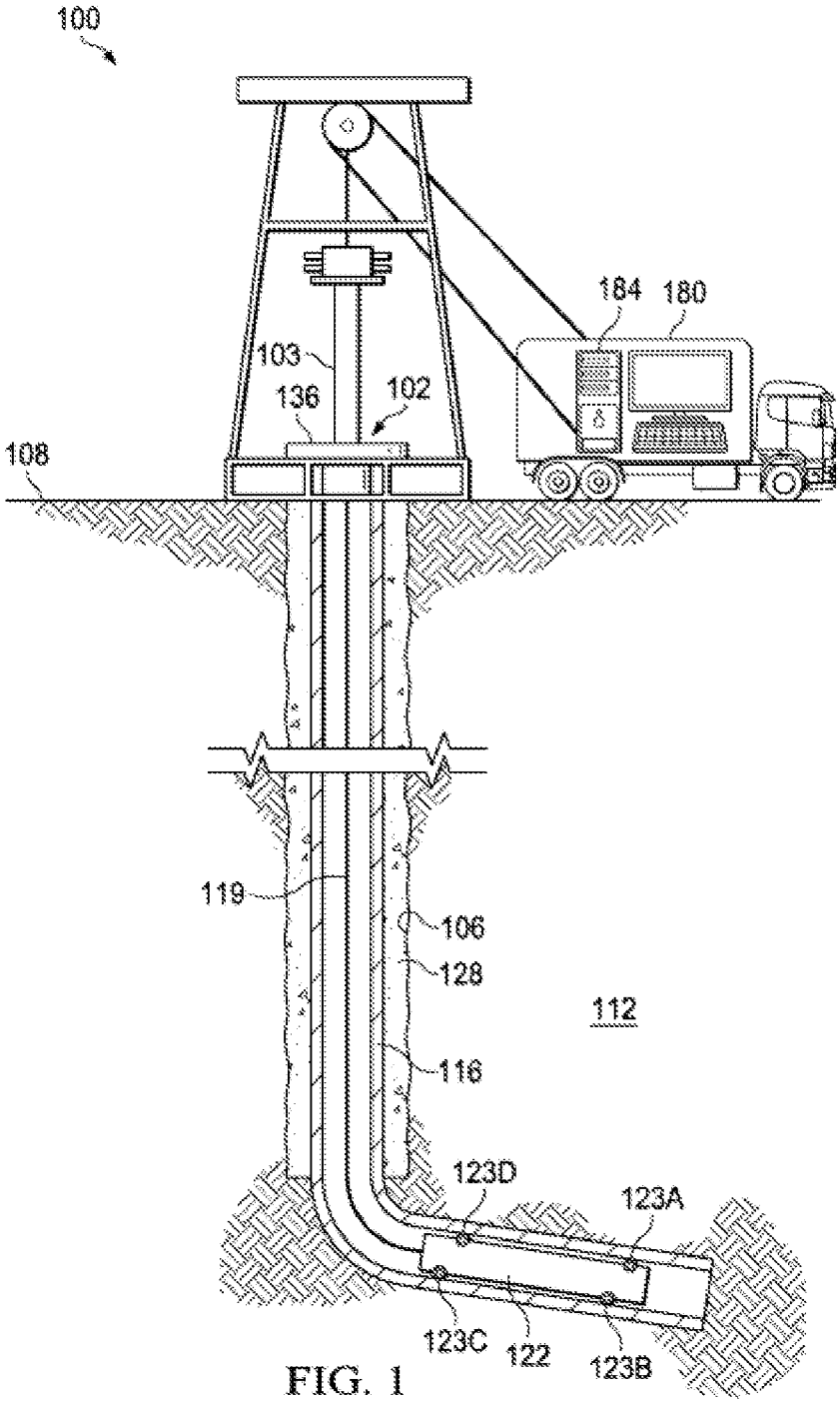
FIG. 1 illustrates a schematic side view of a well having a downhole tractor deployed in a wellbore of the well in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to a downhole tractor. In some embodiments, the downhole tractor has one or more motors powering rotation of wheels that permit traction on a wall of a casing or a wellbore. While the downhole tractor is traversing in the wellbore, in some conditions, wheel slippage may occur when a wheel is worn, when the wheel is over a slippery surface, or when the force applied on the wheel is low. In these conditions, the motors driving these wheels cannot carry the full load, and the net pull force available from the downhole tractor decreases. In some embodiments, the present disclosure may further relate to downhole tractor control systems and methods to maintain a load (or the net pull force) of the downhole tractor when one or more motors are malfunctioning or the driving wheels are slipping.

In some embodiments, the downhole tractor control system may be configured to control and modify the power limits of the one or more motors while maintaining the maximum power limit of the downhole tractor. The downhole tractor control system may reallocate the power limit from malfunctioning/slipping motors to higher load carrying motors (e.g., non-slipping motors) to optimize the tractor performance and to increase the net pull force.

The downhole tractor control system (e.g., a supervisory controller) may be placed at a surface of a well or coupled to the download tractor in the wellbore. In some embodiments, the downhole tractor control system may be an onboard system of the downhole tractor. In some embodiments, one or more components of the downhole tractor control system may be deployed at remote locations relative to the downhole tractor. The downhole tractor control system may be further configured to use a power maximization algorithm for modifying the power limit of the non-slipping motors to a maximum acceptable power threshold. The maximum acceptable power threshold may be either equal to or higher than a desired input power limit of the motors.

In some embodiments, the downhole tractor control system may receive the run-time (real-time) power/speed of each motor and user input of a total power limit of the tractor. The control system then may compare the run-time power of each motor and infer if the system performance is degraded due to one or more motors not sharing the load. When these conditions occur, as part of its power maximization algorithm, the downhole tractor control system may reduce the power limit for the motors (e.g., slipping motors) that cannot share the load and increase the power limit for the motors (e.g., non-slipping motors) that can share the load to a maximum acceptable power threshold while maintaining the total power limit of the tractor.

In some embodiments, the downhole tractor control system may disengage the load sharing feature when the malfunctioning motors are identified. The downhole tractor control system may keep the non-gripping motors (a.k.a. slipping motors) running with low power or disengage a failed motor, and may allow the healthy load-carrying motors to run with higher power within the maximum total power limit of the tractor.

The disclosed power maximization algorithm may improve the tractor performance and maximize the system power capability and hence, increases the pull force. It may further increase the capability to accomplish difficult tractor jobs in extreme conditions. It may further help in maintaining the pull force in adverse downhole conditions and hence, enable the downhole tractors to be deployed for deeper wells with long horizontal sections. Additional descriptions of the downhole tractor control systems and methods to maintain or maximize a load of the downhole tractor in the paragraphs below and are illustrated in at least FIGS. 1-5.

FIG. 1 illustrates a schematic side view of an environment 100, where a downhole tractor 122 may be deployed in a wellbore 106 of a well 102. In the embodiment of FIG. 1, the wellbore 106 may extend from a surface 108 of the well 102 to or through a subterranean formation 112. A casing 116 is deployed along the wellbore 106 to insulate downhole tools and strings deployed in the casing 116 to provide a surface that contacts wheels 123A-123D of downhole tractor 122, to provide a path for hydrocarbon resources flowing from the subterranean formation 112, to prevent cave-ins, and/or to prevent contamination of the subterranean formation 112. The casing 116 may be normally surrounded by a cement sheath 128, which is deposited in an annulus between the casing 116 and the wellbore 106 to fixedly secure the casing 116 to the wellbore 106 and to form a barrier that isolates the casing 116. Although not depicted, there may be layers of casing concentrically placed in the wellbore 106, each having a layer of cement or the like deposited thereabout.

A conveyance 119, optionally carried by a vehicle 180, may be positioned proximate to the well 102. The conveyance 119, along with downhole tractor 122, may be lowered down the wellbore 106, i.e. downhole. In one or more embodiments, the conveyance 119 and the downhole tractor 122 may be lowered downhole through a blowout preventer 103 and a wellhead 136. In the illustrated embodiment of FIG. 1, the conveyance 119 may be a wireline. In one or more embodiments, the conveyance 119 may be wireline, slickline, coiled tubing, drill pipe, production tubing, fiber optic cable, or another type of conveyance operable to deploy the downhole tractor 122. The conveyance 119 may provide mechanical suspension of the downhole tractor 122 as the downhole tractor 122 is deployed downhole. In one or more embodiments, the conveyance 119 may also transmit signals including, but not limited to, optical signals to the downhole tractor 122. In one or more embodiments, the conveyance 119 also may provide power to the downhole tractor 122 as well as other downhole components. In one or more embodiments, the conveyance 119 may also provide downhole telemetry. Additional descriptions of telemetry are provided in the paragraphs below. In one or more embodiments, the conveyance 119 may also provide a combination of power and downhole telemetry to the downhole tractor 122. For example, where the conveyance 119 may be a wireline, coiled tubing (including electro-coiled-tubing), or drill pipe, power and data are transmitted along with the conveyance 119 to the downhole tractor 122.

In the illustrated embodiment of FIG. 1, the downhole tractor 122 may carry a load downhole during well operations. Downhole tractor 122 may include four wheels 123A-123D that are attached to extending arms (not shown) which apply traction to a wall of the casing 116 or the wellbore 106 to facilitate movement of the downhole tractor 122. In some embodiments, the wheels 123A-123D may roll over tracks (not shown) that are placed on a wall of casing 116 or wellbore 106. The downhole tractor 122 also has motors (not shown) that provide power to rotate the wheels 123A-123D. In some embodiments, the downhole tractor 122 may have multiple motors, each configured to provide power to rotate a separate wheel. In some embodiments, each motor of the downhole tractor 122 may be configured to provide power to rotate a different set of wheels (e.g., wheels that are coupled to the same axle). In some embodiments, the wheels 123A-123D may have teeth or other profiles that improve adhesion and help wheels 123A-123D maintain a grip on the tracks while moving on the tracks.

Over time, the wheels 123A-123D may experience wear, thereby causing diameters of different wheels 123A-123D to differ from each other. In some embodiments, different downhole conditions (e.g., presence of oil on the tracks) may also cause different wheels 123A-123D to experience varying amounts of slippage. Further, in some conditions, a set of motors may experience reduction of power because the set of motors staring to slip, set of motors being non-powered because of any fault conditions, or set of motors running at lower power because of malfunctioning. Under these conditions, where the downhole tractor 122 carries an unevenly distributed load, the load on different wheels 123A-123D may also vary, and the net pull force available from the tractor may decrease.

The downhole tractor 122 may comprise a downhole tractor control system (illustrated in FIG. 2) that periodically determines speed, torque, and/or the power generated by each motor. In some embodiments, the downhole tractor control system may compare the determined speed, torque, and power of the motors with desired speed, torque, and power of the motors, and readjusts the output of one or more motors (e.g., the speed and the torque of one or more motors) to maintain the load on the downhole tractor 122. In some embodiments, the desired speed, torque, and power may be provided by an operator. In some embodiments, the desired speed, torque, and power may be dynamically determined based on one or more downhole properties. In some embodiments, the downhole tractor control system may also compare the determined speed, torque, and power of different motors with each other, and adjusts the output of different motors to maintain the load on the downhole tractor 122.

In some embodiments, downhole tractor control system may include a storage medium and processors. Storage medium may be formed from data storage components such as, but not limited to, read-only memory (ROM), random access memory (RAM), flash memory, magnetic hard drives, solid-state hard drives, CD-ROM drives, DVD drives, floppy disk drives, as well as other types of data storage components and devices. In some embodiments, storage medium includes multiple data storage devices. In further embodiments, the multiple data storage devices may be physically stored at different locations. Data indicative of wellbore conditions, the load on the downhole tractor, as well as other data used to adjust motor output of the motors of the downhole tractor are stored at a first location of storage medium. Additional descriptions of operations performed by the downhole tractor control system to maintain the load of the downhole tractor and to achieve the desired motor outputs are provided in the paragraphs below and are illustrated in at least FIGS. 2-5.

Figure 2:
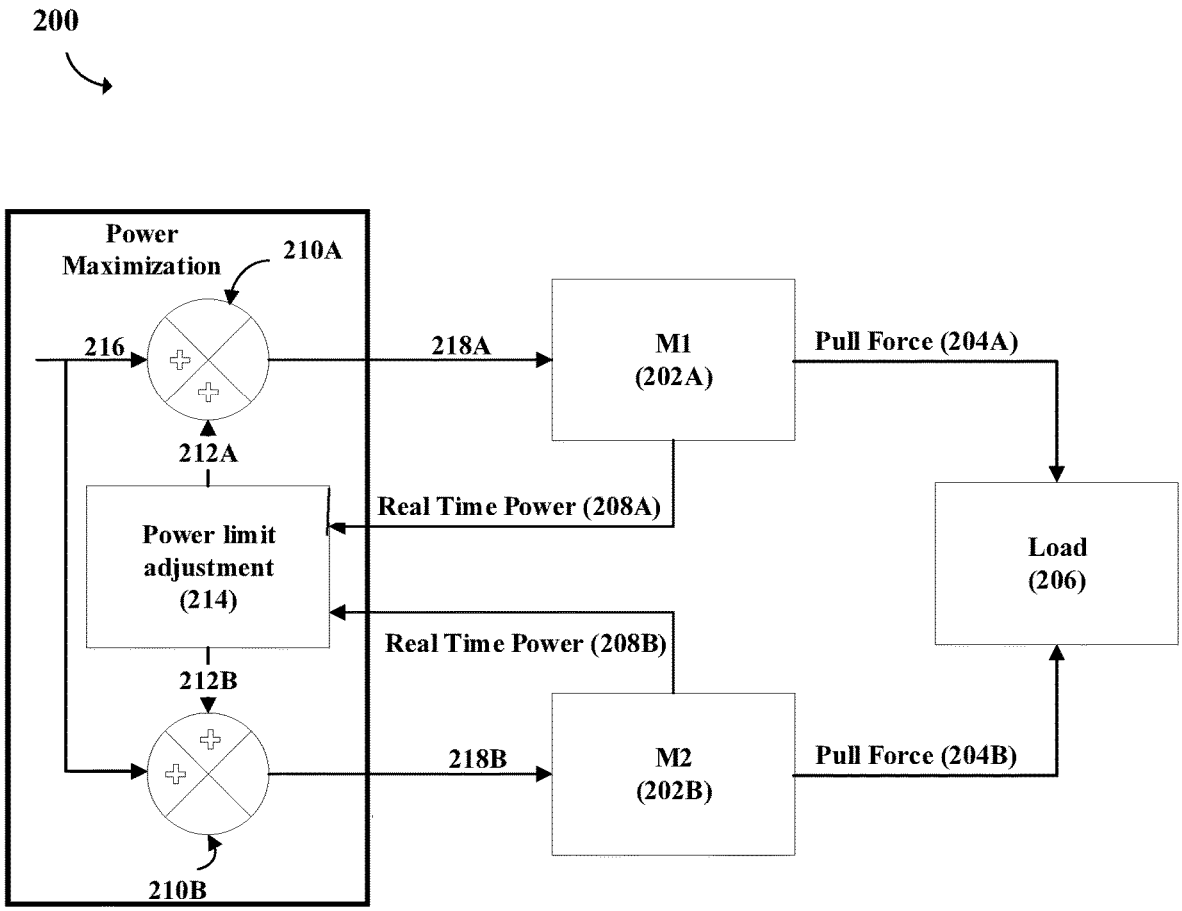
FIG. 2 illustrates a system diagram of a downhole tractor control system of the downhole tractor of FIG. 1 and is configured to maintain a load of a downhole tractor in accordance with embodiments of the present disclosure.

FIG. 2 illustrates a system diagram of a downhole tractor control system 200 of the downhole tractor 122 of FIG. 1 and is configured to modify the power limit of multiple motors of the downhole tractor to a maximum acceptable power limit while maintaining total power limit or load 206 of the downhole tractor 122. The downhole tractor control system 200 may be deployed on a surface-based electronic device, such as controller 184 of FIG. 1, or coupled to the downhole tractor 122 in the wellbore. In one or more embodiments, downhole tractor control system 200 may include telemetry systems operable to transmit data between the downhole tractor 122 and the controller 184 of FIG. 1. In one or more of such embodiments, downhole tractor controller 200 may also include transmitters, receivers, transceivers, as well as other components used to transmit data between the downhole tractor 122 and the controller 184 of FIG. 1.

As shown in FIG. 2, in particular, the downhole tractor control system 200 may employ two permanent magnet synchronous machine (PMSM) motors (202A, 202B). However, in one or more embodiments, the machine types may differ with a different number of motors. For example, the downhole tractor may have four motors such as induction motors, DC motors, or other types of motors. The two motors 202A, 202B may further be coupled to voltage source invertors (not shown in the FIGs.). The downhole tractor control system 200 may be configured to take in one input of a desired speed, a desired torque, or a desired power of the motors 202A, 202B. In some embodiments, the desired speed is expressed in revolutions per minute, the desired torque is expressed in newton meters, and the desired power is expressed in watts (W). In some embodiments, an operator may enter these desired parameters. In some embodiments, downhole tractor control system 200 may dynamically determine the desired parameters based on current wellbore conditions as well as the load 206 on downhole tractor 122.

For each motor, the downhole tractor control system may then utilize feedback controllers to monitor a feedback value (a.k.a., a real-time value) of these parameters (e.g., speed, torque, or power) to identify whether a set of motors are experiencing reduction of power (e.g., set of motors driving a slipping wheel, being non-powered, or malfunctioning). In some embodiments, the feedback controller may be a proportional-integral controller or a proportional-integral-derivative controller. The downhole tractor control system may receive power feedback (a.k.a., real-time power or run time power) or speed feedback of each motor and user input of a power reference/speed reference (i.e. desired power/speed) of each motor. The downhole tractor control system may compare the power/speed feedback with the desired power/speed for each motor respectively, infers if any motor is driving a slipping wheel based on the comparison, and then adjusts the power/speed limit of each motor to maintain the load of the downhole tractor.

As shown in FIG. 2, the downhole tractor control system may run a power maximization algorithm to monitor power feedback 208A of a first motor 202A, power feedback 208B of a second motor 202B, and user input of a desired power reference of each motor. The downhole tractor controller may compare the power feedbacks 208A and 208B with the desired power reference of the first motor 202A, the second motor 202B respectively, and infers if any motor is driving a slipping wheel. In some embodiments, the slip of the motor may be detected when the power feedback (208A or 208B) of at least one motor is below the desired power reference.

The downhole tractor control system may enter power feedback of each motor (202A, 202B) as an input of a power limit adjustment controller 214, and obtain an output of the power limit adjustment controller 214. The downhole tractor control system may further include a first summing junction 210A at which the power limit modification 212A (e.g., the output of power limit adjustment controller) is summed with power limit reference (as shown by arrow 216) of the first motor 202A to generate a modified power limit (as shown by arrow 218A) which is provided as an input to the motor 202A. Similarly, in some embodiments, a second summing junction 210B may be provided at which the power limit modification 212B is summed with power limit reference (as shown by arrow 216) of the second motor 202A to generate a modified power limit (as shown by arrow 218B) which is provided as an input to tractor 202B.

The power maximization algorithm may adjust the power limit of each motor and the adjusted power of each tractor may be designated as power limit modification 212A and 212B for the first tractor 202A and the second tractor 202B respectively. The power maximization algorithm may adjust the power limit of each motor in such a way that the sum of power limit modification 212A and power limit modification 212B is zero to maintain the sum of modified power limit 218A and modified power limit 218B the same, and to maximize the net pull force (i.e. pull force 204A of motor 202A+pull force 204B of motor 202B) of the tractor.

Here is an example of implementing the power maximization algorithm as described with respect to FIG. 2. As discussed above, the downhole tractor control system may run a power maximization algorithm to monitor the power feedback and speed feedback of each motor to determine whether the power limits of the motors need to be changed. The different downhole conditions may trigger reduction in power among motors such as: 1) when the tractor slows down and cannot meet the desired speed reference, 2) one or more motors (e.g., slipping motors) may be running with low power and indicating that the motors are slipping and cannot deliver more power, and 3) one or more motors (e.g., non-slipping motors) other than slipping motors are running with high power which is close to the power limit reference of the motor. It means that the non-slipping motors are capable of delivering more power but limited by the power limit reference.

When the above conditions are met, the power maximization algorithm may reallocate the unused power budget of slipping motors to non-slipping motors. The example of two motors M1 and M2 (e.g., 202A and 202B) is given below. Each motor M1 and M2 may have the power limit reference (e.g. as shown by arrow 216) as 600 W and the tractor may be limited to load (e.g. 206) 1.2 Kilowatt (kW) with two motors. Each motor may be commanded to deliver linear force of 1000N (e.g., pull force 204A of the motor M1 or pull force 204B of the motor M2) with 0.5 m/s linear speed, assuming 100% efficiency. In normal condition, each motors M1 and M2 may run with 500 W power to meet the desired speed and power/force requirements.

Consider the case when the motor M2 is slipping, it cannot deliver more than 500N force. At 0.5 m/s speed condition, it may only deliver power feedback (e.g., 208B)

of 250 W. Then, the downhole tractor may deliver 250+600=850 W as the maximum power limit of the entire tractor, which is less than 1 kW, load and speed requirements. In this case, both motors M1 and M2 may slow down to accommodate the slipping motor M2.

Without the power maximization algorithm, the motor M1 may need to generate 1500N force to move the downhole tractor. Considering the 600 W power limit of the motor, the motor M1 may only run at speed of 0.4 m/s (i.e. 600 W/1500N=0.4 m/s). Since the motors M1 and M2 are coupled with the tractor, they may have similar linear speed. Then, the motor M2 may run with 0.4 m/s speed and 500N force, equal to 0.4×500=200 W. Then, the entire downhole tractor may run at 0.4 m/s speed with the total output power of 200 W+600 W=800 W.

When the downhole tractor slows down and there is unbalance in power between motors, the power maximizer or power maximization algorithm may be engaged. The power maximization algorithm may adjust the power limit of each motor in such a way that the sum of power limit modification 212A and power limit modification 212B remains zero to maintain the sum of modified power limit 218A and modified power limit 218B, and to maximize the load 206 of the tractor. In some embodiments, the power maximization algorithm may adjust the power limit for the motors M1 and M2 based on current power output of the motor M2 with a certain margin, for example 200W+20 W=220 W. Considering the 600 W power limit of the motor, the power limit modification 212A may be 600 W−220 W=380 W for the first tractor 202A and the power limit modification 212B may be 220 W−600 W=−380 W for the second tractor 202B. Based on adjusted power limits, the power maximization algorithm may further modify the power of the motor M1 based on the motor M2's power limit, such as 600 W+(600 W−220 W)=980 W. With these modified power limits (e.g., 218A and 218B), the motor M1 may run 0.65 m/s with 1500N force and the motor M2 may run 0.44 m/s with 500N force. Since the two motors are coupled with the tractor, they may run at the lowest speed, which is 0.44 m/s in this case.

However, the power margin of 20 W applied on the motor M2 may keep increasing the power limit further. So, the motor M2 may speed up until the modified power limit (e.g., 218B) for the motor M2 goes beyond 250 W, which means it can run 0.5 m/s with 500 Nm load. At the same time, the power limit (e.g., 218A) for the motor M1 will be 600+(600−250−20)=930 W, which equals to 1500N force at 0.62 m/s. Thus, it may also be sufficient for the motor M1 to run 0.5 m/s with 1500N force. Then, the tractor may run at 0.5 m/s with total 1000N force with power maximization algorithm. As can be seen, the speed of the tractor has been reached to 0.5 m/s and the system performance has been optimized using power maximization algorithm as compared to 0.4 m/s speed of the tractor without the maximization algorithm engaged.

In some embodiments, detection of loss of motor power may also be done by comparing the speed of the motors and determining the motors that are slipping. In this case, a user input of a desired speed for a plurality of motors of the downhole tractor may be received. Then, actual speed of the motors may be compared with the desired speed. A reduction of power (or loss of power) of a first set of motors of the plurality of motors may be identified based on the comparison, and then a maximizer algorithm may increase the power of the non-slipping motors until the non-slipping motors start to reduce the power, non-slipping motors reach a rated power limit, or the downhole tractor reaches a total power limit.

Figure 3A:
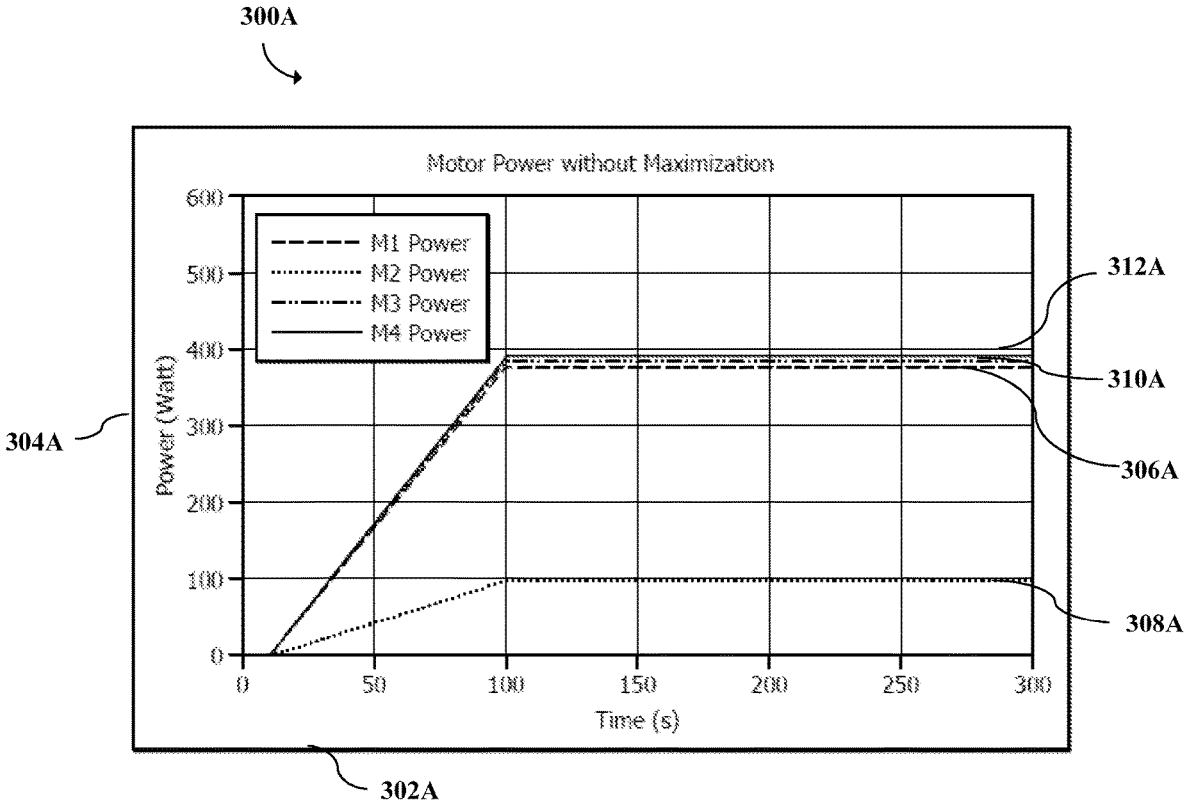
FIG. 3A illustrates simulated results of power of a plurality of motors of a downhole tractor that does not perform the operations described herein in accordance with embodiments of the present disclosure.

FIG. 3A illustrates simulated results of power of a plurality of motors over time, where a downhole tractor that does not perform the operations described herein and illustrated in FIG. 2 while operating in a condition where one of the wheels experiences slippage. Shown in FIG. 3A is a graph 300A of the power feedback of the plurality of motors (e.g., four) over time, where x-axis 302A may represent time, y-axis 304A may represent power, a line 306A may represent a first power feedback of a first motor M1, a line 308A may represent a second power feedback of a second motor M2, a line 310A may represent a third power feedback of a third motor M3, and a line 312A may represent a fourth power feedback of a fourth motor M4.

As shown in FIG. 3A, the second motor M2 is driving a slipping wheel and has a lower value of the second power feedback 308A (e.g., 150 W) as compared to other motors (e.g., M1, M3, and M4). The graph is showing that the first power feedback 306A, the third power feedback 310A, and the fourth power feedback 312A of the other motors may be clamped at approximately 390 W, which is one-fourth (¼) of the total power limit of the downhole tractor. Due to the low second power feedback 308A of the second motor M2, the total power capability of the tractor may not be fully used. When power maximization algorithm is not engaged, the power limit reference may be used to limit the maximum power of each motor directly. The power limit reference may be calculated by the total power limit of the entire tractor divided by the number of motors. If the motor maximum power capability is higher than the power limit reference, the power maximization algorithm may be applied for optimization. Thus, a power maximization algorithm may be engaged for maximizing the power of the non-slipping motors (M1, M3, and M4 in this case) till a maximum motor limit is reached or if the tractor's total power limit is reached.

Figure 3B:
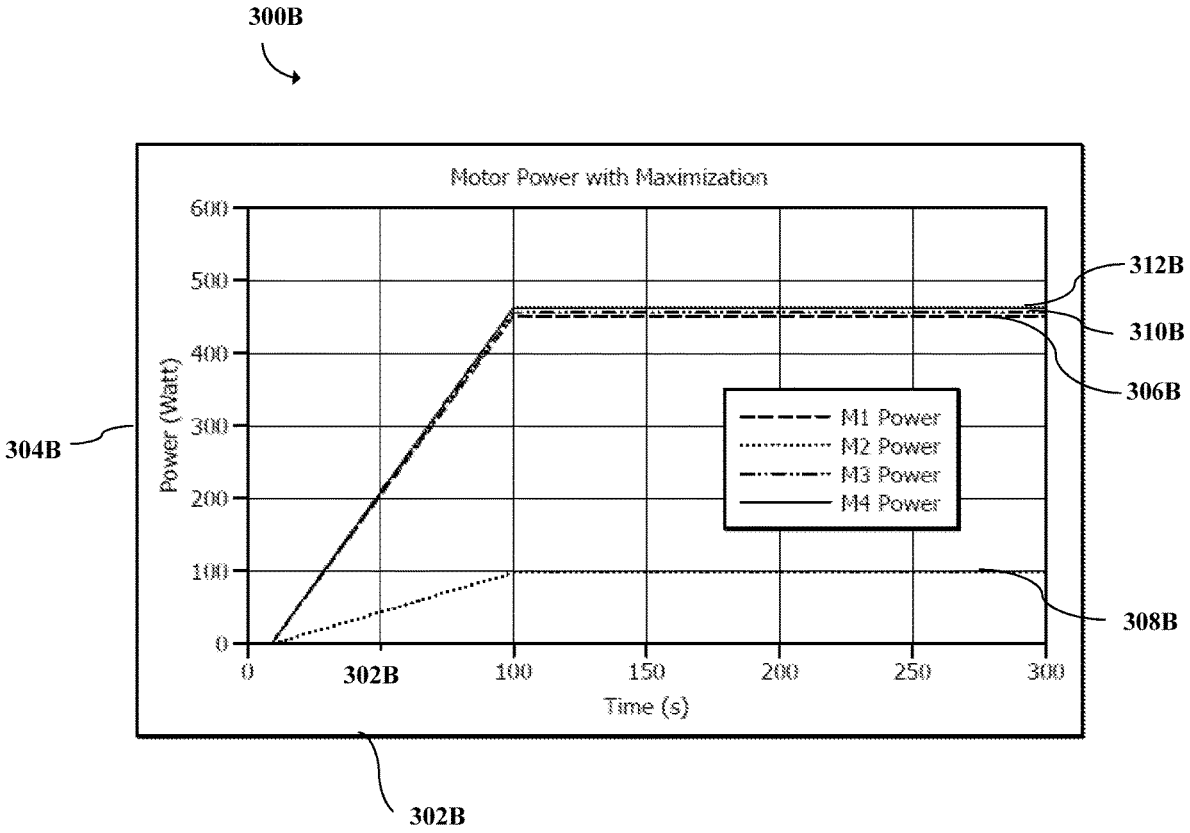
FIG. 3B illustrates simulated results of maximizing the power limit of a plurality of non-slipping motors of a downhole tractor that performs the operations described herein and illustrated in FIG. 2 in accordance with embodiments of the present disclosure.

FIG. 3B illustrates simulated results of maximizing the power limit of a plurality of non-slipping motors, where a downhole tractor performs the operations described herein and illustrated in FIG. 2. Shown in FIG. 3B is a graph 300B of the maximizing power limit of a plurality of non-slipping motors over time, where x-axis 302B may represent time, y-axis 304B may represent current, a line 306B may represent a maximum power limit of a first motor M1, a line 310B may represent a maximum power limit of a third motor M3, a line 312A may represent a fourth maximum power limit of a fourth motor, and whereas a line 308B may represent a power feedback of a second motor M2.

As shown in FIG. 3A, the second motor M2 is driving a slipping wheel and has lower power as compared to the other motors. To compensate for the loss of power of slipping motor M2, the maximum power limit of non-slipping motors (e.g., M1, M3, and M4) may be increased and the maximum power limit of the slipping motor (e.g. M2) may be decreased while maintaining the power limit of the downhole tractor. More particularly, the maximum power limit reduction may be implemented with a certain margin that will not limit the slipping motor performance. The total power budget saved from slipping motors may be applied to the non-slipping motors. It may ensure the total power consumption of all motors is still within the total power system limit. By increasing the maximum power limit of non-slipping motors, the output power of the tractor may be increased. As it can be seen in FIG. 3B, the non-slipping motors may maximize the power to 450 W, which is greater than the power shown in FIG. 3A. Thus, a power maximization algorithm implemented to increase the power of the non-slipping motors may improve the tractor performance and maximize the system power capability and the pull force. It may further increase the capability to accomplish difficult tractor jobs in extreme conditions. This feature may maintain the pull force in adverse downhole conditions and hence may enable the tractors to be deployed for deeper wells with long horizontal sections.

Figure 4:
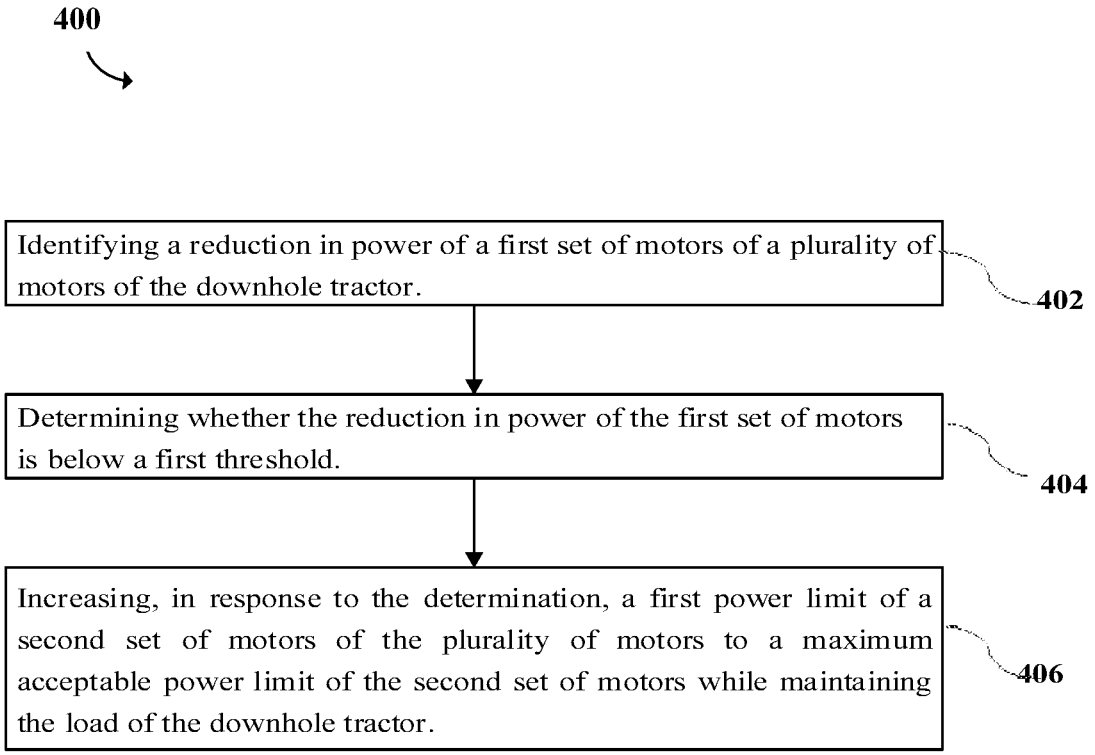
FIG. 4 illustrates a flow chart of a process to maintain a load of a downhole tractor in accordance with embodiments of the present disclosure.

FIG. 4 illustrates a flow chart of a process 400 to maintain a power of a downhole motor. Although the operations in the process 400 are shown in a particular sequence, certain operations may be performed in different sequences or at the same time where feasible. Further, although the operations in process 400 are described to be performed by downhole tractor control system 200, the operations may also be performed by one or more processors of other electronic devices operable to perform operations described herein. As described below, process 400 provides an intuitive way for maintaining the load on a downhole tractor deployed during well operations and in well environments including in the environment of FIG. 1. The process may maintain a load of a downhole tractor by modifying the power limits of one or more motors while maintaining the total tractor power consumption. The downhole tractor controller may reallocate the power limit from malfunctioning or slipping motors to higher load carrying motors (e.g., non-slipping motors), thereby optimizing the performance of the downhole tractor, and increasing the net pull force. This is not limited in this embodiment of this application. The method may be implemented by using the following steps 402 to 406.

At step 402, the method 400 may comprise identifying a reduction of power of a first set of motors of a plurality of motors of the downhole tractor.

At step 404, the method 400 may comprise making a determination of whether the reduction of power of the first set of motors is below a first threshold.

Figure 5:
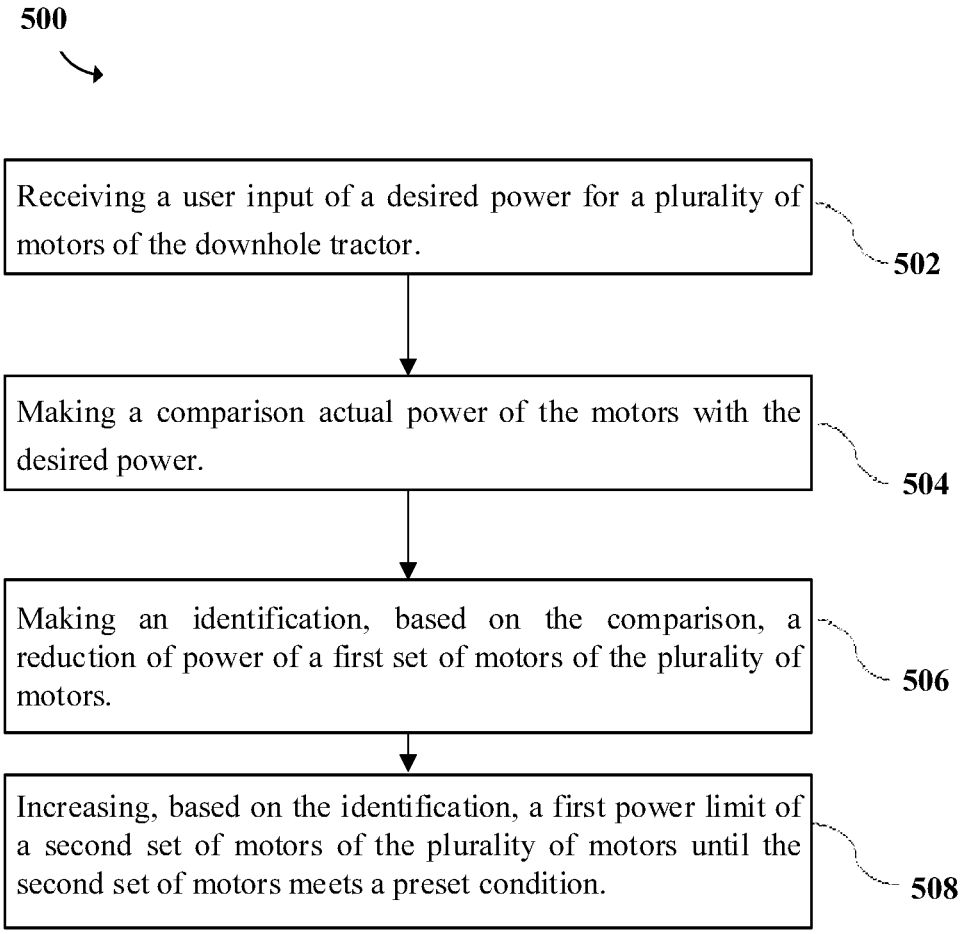
FIG. 5 illustrates another flow chart of a process to maintain a load of a downhole tractor in accordance with embodiments of the present disclosure.

At step 406, the method 400 may comprise increasing, in response to the determination, a first power limit of a second set of motors of the plurality of motors to a maximum acceptable power limit of the second set of motors while maintaining the load of the downhole tractor. In some embodiments, the method 400 may further comprise decreasing, in response to the determination, a second power limit of the first set of motors to a second threshold, wherein the first set of motors has reduced power, and wherein the second set of motors is running close to the first power limit FIG. 5 illustrates a flow chart of a process 500 to maintain a power of a downhole motor. Although the operations in the process 500 are shown in a particular sequence, certain operations may be performed in different sequences or at the same time where feasible. Further, although the operations in process 500 are described to be performed by downhole tractor controller 200, the operations may also be performed by one or more processors of other electronic devices operable to perform operations described herein. As described below, process 500 provides an intuitive way for maintaining the load on a downhole tractor deployed during well operations and in well environments including in the environment of FIG. 1. The process may maintain a load of a downhole tractor by modifying the power limits of one or more motors while maintaining the total tractor power consumption. The downhole tractor controller may reallocate the power limit from malfunctioning or slipping motors to higher load carrying motors (e.g., non-slipping motors), thereby optimizing the performance of the downhole tractor, and increasing the net pull force. The method may be implemented by using the following steps 502 to 508.

At step 502, the method 500 may comprise receiving a user input of a desired power for a plurality of motors of the downhole tractor.

At step 504, the method 500 may comprise making a comparison of actual power of the motors with the desired power.

At step 506, the method 500 may comprise making an identification, based on the comparison, a reduction of power of a first set of motors of the plurality of motors.

At step 508, the method 500 may comprise increasing, based on the identification, a first power limit of a second set of motors of the plurality of motors until the second set of motors meets a preset condition. In some embodiments, the preset condition comprises the set of second motors starting to reduce power, the set of second motors reaching a rated power limit, or the downhole tractor reaching a total power limit. In some embodiments, the method further comprising decreasing a second power limit of the first set of motors to a second threshold, wherein the first set of motors comprises a set of motors with reduced power, and wherein the second set of motors comprises a set of motors running close to the first power limit.

ADDITIONAL DISCLOSURE

The following are non-limiting, specific embodiments in accordance with the present disclosure:

A first embodiment, which is a method to adjust a load among a plurality of downhole tractors, implemented by a downhole tractor control system, comprising identifying a reduction of power of a first set of motors of a plurality of motors of the downhole tractor, making a determination whether the reduction of power of the first set of motors is below a first threshold, and increasing, in response to the determination, a first power limit of a second set of motors of the plurality of motors to a maximum acceptable power limit of the second set of motors while maintaining the load of the downhole tractor.

A second embodiment, which is the method of the first embodiment, further comprising decreasing, in response to the determination, a second power limit of the first set of motors to a second threshold.

A third embodiment, which is the method of any of the first and the second embodiments, wherein the first set of motors has reduced power, and wherein the second set of motors is running close to the first power limit.

A fourth embodiment, which is the method of any of the first through the third embodiments, wherein identifying the reduction of power comprises receiving a first user input of a desired power for the first set of motors and the second set of motors, and determining whether power feedback of the first set of motors is below the desired power for the first set of motors, wherein the power feedback comprises a real-time power of the first set of motors.

A fifth embodiment, which is the method of any of the first through the fourth embodiments, further comprising receiving a second user input of a desired power limit of the downhole tractor, and increasing the first power limit of the second set of motors corresponding to the desired power limit of the downhole tractor.

A sixth embodiment, which is the method of any of the first through the fifth embodiments, wherein identifying the reduction of power comprises receiving a user input of a desired torque for the first set of motors and the second set of motors, and determining whether a feedback torque of the first set of motors is below the desired torque of the first set of motors.

A seventh embodiment, which is the method of any of the first through the sixth embodiments, further comprising determining a torque error based on the desired torque and the feedback torque, and increasing the first power limit of the second set of motors based on the torque error while maintaining the load of the downhole tractor.

An eighth embodiment, which is the method of any of the first through the seventh embodiments, wherein identifying the reduction of power comprises receiving a user input of a desired speed for the first set of motors and the second set of motors, and determining whether a feedback speed of the first set of motors is below the desired speed of the first set of motors.

A ninth embodiment, which is the method of any of the first through the eighth embodiments, further comprising determining a speed error based on a difference between a desired speed and a feedback speed of the first set of motors, and increasing the first power limit of the second set of motors based on the speed error while maintaining the load of the downhole tractor.

A tenth embodiment, which is the method of any of the first through the ninth embodiments wherein the downhole tractor controller is either located at a surface of a well or coupled to the downhole tractor.

An eleventh embodiment, which is the method of any of the first through the tenth embodiments, further comprising modifying power limit of the plurality of motors using a power maximization algorithm.

A twelfth embodiment, which is a method to maintain a load of a downhole tractor implemented by a downhole control system, comprising receiving a user input of a desired power for a plurality of motors of the downhole tractor, making a comparison of actual power of the motors with the desired power, making an identification, based on the comparison, a reduction of power of a first set of motors of the plurality of motors, and increasing, based on the identification, a first power limit of a second set of motors of the plurality of motors until the second set of motors meets a preset condition.

A thirteenth embodiment, which is the method of the twelfth embodiment, wherein the preset condition comprises the set of second motors starting to reduce power, the set of second motors reaching a rated power limit, or the downhole tractor reaching a total power limit.

A fourteenth embodiment, which is the method of any of the twelfth and the thirteenth embodiments, further comprising decreasing a second power limit of the first set of motors to a second threshold.

A fifteenth embodiment, which is the method of any of the twelfth through the fourteenth embodiments, wherein the first set of motors has reduced power, and wherein the second set of motors are running close to the first power limit.

A sixteenth embodiment, which is the method of any of the twelfth through the fifteenth embodiments, further comprising receiving a second user input of a desired power limit of the downhole tractor, and increasing the first power limit of the second set of motors corresponding to the desired power limit of the downhole tractor.

A seventieth embodiment, which is the method of any of the twelfth through the sixteenth embodiments, wherein the downhole tractor controller is either located at a surface of a well or coupled to the downhole tractor.

An eighteenth embodiment, which is the method of any of the twelfth through the seventieth embodiments, further comprising modifying power limit of the plurality of motors using a power maximization algorithm A nineteenth embodiment, which is a downhole tractor control system comprising a memory configured to store instructions and a processor coupled to the memory, wherein the instructions cause the processor to be configured to identify a reduction of power of a first set of motors of a plurality of motors of the downhole tractor, make a determination whether the reduction of power of the first set of motors is below a first threshold, and increase, in response to the determination, a first power limit of a second set of motors of the plurality of motors to a maximum acceptable power limit of the second set of motors while maintaining the load of the downhole tractor.

A twentieth embodiment, which is the downhole tractor control system of the nineteenth embodiment, wherein the instructions cause the processor to be configured to decrease, in response to the determination, a second power limit of the first set of motors to a second threshold, wherein the first set of motors has reduced power, and wherein the second set of motors is running close to the first power limit.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method to maintain a load of a downhole tractor implemented by a downhole tractor control system, the method comprising:

identifying a reduction of power of a first set of motors of a plurality of motors of the downhole tractor;

making a determination whether the reduction of power of the first set of motors is below a first threshold; and increasing, in response to the determination, a first power limit of a second set of motors of the plurality of motors to a maximum acceptable power limit of the second set of motors while maintaining the load of the downhole tractor.

2. The method of claim 1, further comprising decreasing, in response to the determination, a second power limit of the first set of motors to a second threshold.

3. The method of claim 1, wherein the first set of motors has reduced power, and wherein the second set of motors is limited by the first power limit.

4. The method of claim 1, wherein identifying the reduction of power comprises:

receiving a first user input of a desired power for the first set of motors and the second set of motors; and determining whether power feedback of the first set of motors is below the desired power for the first set of motors, wherein the power feedback comprises a real-time power of the first set of motors.

5. The method of claim 4, further comprising:

receiving a second user input of a desired power limit of the downhole tractor; and increasing the first power limit of the second set of motors corresponding to the desired power limit of the downhole tractor.

6. The method of claim 1, wherein identifying the reduction of power comprises:

receiving a user input of a desired torque for the first set of motors and the second set of motors; and determining whether a feedback torque of the first set of motors is below the desired torque of the first set of motors.

7. The method of claim 6, further comprising:

determining a torque error based on a difference the desired torque and the feedback torque; and increasing the first power limit of the second set of motors based on the torque error while maintaining the load of the downhole tractor.

8. The method of claim 1, wherein identifying the reduction of power comprises:

receiving a user input of a desired speed for the first set of motors and the second set of motors; and determining whether a feedback speed of the first set of motors is below the desired speed of the first set of motors.

9. The method of claim 8, further comprising:

determining a speed error based on a difference between the desired speed and the feedback speed; and increasing the first power limit of the second set of motors based on the speed error while maintaining the load of the downhole tractor.

10. The method of claim 1, wherein the downhole tractor control system is either located at a surface of a well or coupled to the downhole tractor.

11. The method of claim 1, further comprising modifying power limit of the plurality of motors using a power maximization algorithm.

12. A method to maintain a load of a downhole tractor implemented by a downhole tractor control system, the method comprising:

receiving a user input of a desired power for a plurality of motors of the downhole tractor;

making a comparison of actual power of the motors with the desired power;

making an identification, based on the comparison, a reduction of power of a first set of motors of the plurality of motors; and increasing, based on the identification, a first power limit of a second set of motors of the plurality of motors until the second set of motors meets a preset condition.

13. The method of claim 12, wherein the preset condition comprises:

the set of second motors starting to reduce power, the set of second motors reaching a rated power limit, or the downhole tractor reaching a total power limit.

14. The method of claim 12, further comprising decreasing a second power limit of the first set of motors to a second threshold.

15. The method of claim 12, wherein the first set of motors has reduced power, and wherein the second set of motors are limited by the first power limit.

16. The method of claim 12, further comprising:

receiving a second user input of a desired power limit of the downhole tractor; and increasing the first power limit of the second set of motors corresponding to the desired power limit of the downhole tractor.

17. The method of claim 12, wherein the downhole tractor control system is either located at a surface of a well or coupled to the downhole tractor.

18. The method of claim 12, further comprising modifying power limit of the plurality of motors using a power maximization algorithm.

19. A downhole tractor control system comprising:

a memory configured to store instructions; and a processor coupled to the memory, wherein the instructions cause the processor to be configured to:

identify a reduction of power of a first set of motors of a plurality of motors of the downhole tractor;

make a determination whether the reduction of power of the first set of motors is below a first threshold; and increase, in response to the determination, a first power limit of a second set of motors of the plurality of motors to a maximum acceptable power limit of the second set of motors while maintaining the load of the downhole tractor.

20. The downhole tractor control system of claim 19, wherein the instructions cause the processor to be configured to decrease, in response to the determination, a second power limit of the first set of motors to a second threshold, wherein the first set of motors has reduced power, and wherein the second set of motors is limited by the first power limit.

* * * * *